US005432307A

United States Patent [19]

Maurer

[11] Patent Number: 5,432,307

[45] Date of Patent: Jul. 11, 1995

[54] NOISE DAMPER FOR AIR PRESSURE OPERATED TOOLS

[75] Inventor: Werner Maurer, Nuertingen, Germany

[73] Assignee: Karl M. Reich Maschinenfabrik GmbH, Nuertingen, Germany

[21] Appl. No.: 151,493

[22] Filed: Nov. 12, 1993

[30] Foreign Application Priority Data

Nov. 21, 1992 [DE] Germany ..... 42 39 156.3

[51] Int. Cl.[6] ..... F01N 1/08

[52] U.S. Cl. ..... 181/230

[58] Field of Search ..... 181/230, 228, 237, 208

[56] References Cited

U.S. PATENT DOCUMENTS 2,678,637 5/1954 Doeden ..... 181/230
3,783,590 1/1974 Allen ..... 181/230 X
3,809,179 5/1974 Delaney, Jr. et al. ..... 181/230
4,113,052 9/1978 McElroy, Jr. ..... 181/230
4,320,864 3/1982 Novak et al. ..... 181/230 X

FOREIGN PATENT DOCUMENTS 2422222 11/1975 Germany .

*Primary Examiner*—Khanh Dang
*Attorney, Agent, or Firm*—W. G. Fasse; W. F. Fasse

[57] ABSTRACT

Exhaust noise emitted by a pneumatically operated tool, such as a nailer, is damped by an external damping ring which surrounds the exhaust openings. Preferably, the damping ring is inserted into an outwardly open circumferential groove into which the exhaust openings of the tool housing merge. The ring is sufficiently elastic to permit the escape of the exhaust air, thereby damping the noise. The ring may be an elastic rubber or synthetic material ring (12) or it may be a tightly woven ring spring (12A).

7 Claims, 1 Drawing Sheet

NOISE DAMPER FOR AIR PRESSURE OPERATED TOOLS

FIELD OF THE INVENTION

The invention relates to a noise damper for air pressure operated tools, such as jack hammers, pneumatic wrenches, and the like.

BACKGROUND INFORMATION

German Patent Publication (DE-OS) 2,422,222 (Maurer), published on Nov. 20, 1975 discloses a noise damper element for a pneumatic nailing gun. The previous noise damper element comprises a cylindrical sleeve with perforations. The sleeve is arranged inside the housing of the pneumatic nailing gun in front of the exhaust openings of the gun housing. Such a noise damping element must be especially manufactured for the intended purpose so that it is relatively expensive. Additionally, it must be fitted inside the nailer housing when the nailer is assembled. Further, the known noise damping element has been found to be less effective when high exit pressures of the exhaust air must be dampened. Another drawback of arranging the noise damping element inside the exhaust path is seen in that it adversely affects the return stroke of the driver piston. Thus, there is room for improvement.

OBJECTS OF THE INVENTION

In view of the foregoing it is the aim of the invention to achieve the following objects singly or in combination:

- to provide a simple and thus inexpensive noise damping element of the type described above that nevertheless assures a high damping of the exhaust noise in a pneumatically driven tool;
- to avoid the installation of the noise damping element inside the exhaust path in the housing of the tool; and
- to make it possible to apply the exhaust noise damping element externally to the housing of the tool.

SUMMARY OF THE INVENTION

The above objects have been achieved according to the invention by constructing the noise damper element as a closed, namely endless elastic ring which is positioned around the outer end of the exhaust openings of the tool housing, whereby the elasticity of the ring is such that the ring can be lifted off the air exhaust openings or air exhaust port or ports by the outflowing exhaust air of the tools while closing the openings when the tool is not operating whereby during operation the air exhaust port or ports are repeatedly opened and closed.

Tests have shown that the noise damper according to the invention reduces output noise of about 101db to about 88db without any adverse effects on the backstroke of the driving piston in an automatic, pneumatically driven nailing gun or nailer.

The damping element itself may either be a ring-shaped, endless spring or an O-ring made of sufficiently elastic synthetic material, whereby the element itself is relatively inexpensive, yet achieves a substantial improvement in the noise damping effect. It is important that the elasticity of the element is so selected that it will sufficiently yield to the exhaust flow without rigidly closing the exhaust openings.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
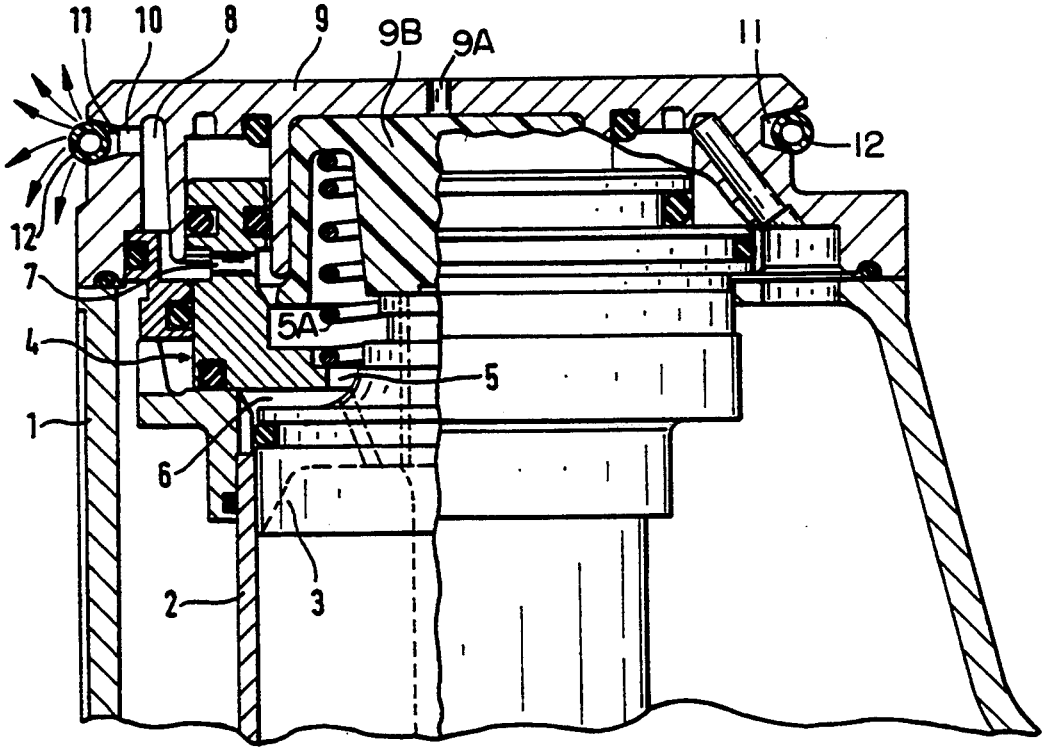
FIG. 1 shows an embodiment of the present invention as applied to the housing of a pneumatically driven nailing gun shown partially in section.

FIG. 1 shows a toll housing 1 including a cylinder head 9 of a pneumatically operated automatic nailer. A cylinder 2 is conventionally mounted in the housing 1 and a driver piston 3 moves back and forth in the cylinder 2. A valve 4 functions as the control of the back and forth movement of the driver piston 3. The valve 4 is mounted in the cylinder head 9 of the housing. The valve 4 is shown in its flow closing position.

The valve 4 has an axial bore 5 forming a shoulder on which one end of a compression spring 5A rests. The bore 5 in the valve 5 communicates with the space 6 in the cylinder 2 above the piston 3. The valve 4 also has radial bores 7 which open into a ring space 8 forming an air exhaust channel in the cylinder head 9 of the housing 1. Air exhaust parts 10 communicate the ring space 8 with the atmosphere. These openings air exhaust parts 10 are circumferentially distributed in the cylinder head 9, preferably at equal angular spacings and are open to the atmosphere.

According to the invention, a noise damping ring member 12 is arranged circumferentially around the air exhaust ports 10 which are normally closed by the damping element ring member 12. The noise damping ring member 12 is preferably an elastic ring such as an O-ring that can yield radially outwardly when exhaust air wants to pass outwardly through the air exhaust ports 10. The ring member 12 may, for example, be made of sufficiently elastic synthetic material or rubber or the like. The elastic ring member may be hollow.

Preferably, the air exhaust ports 10 open into a circumferential groove 11 which in turn is open to the atmosphere. The grove 11 has preferably a trapezoidal or funnel shaped cross-section as shown in FIG. 1. The noise damping ring member 12 is at least partially received in the circumferential groove 11. The cylinder head 9 is provided with a venting opening 9A to facilitate the insertion and removal of a seal 9B which also contributes to noise dampening. For this purpose the seal 9B is made of a suitable material such as rubber or synthetic elastic material.

Figure 2:
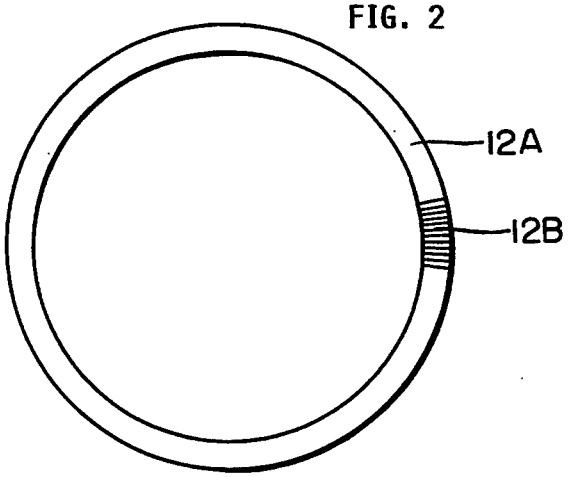
FIG. 2 is a plan view of a noise damper ring in the form of a tightly wound closed spring wire ring.

Instead of the elastic ring member 12, a tightly wound ring or endless spring element 12A is used as shown in FIG. 2. The spring element 12A has tightly woven windings 12B of metal only a few windings 12B are shown to simplify the illustration. These windings 12B extend all around the sealing ring spring element 12A. The noise damping ring spring element 12A is dimensioned to fit into the groove 11.

When the driving piston 3 performs its return stroke, air present in the space 6 passes through the bores 5 and 7 into the ring space or channel 8 and from there into the air exhaust ports 10, whereby the noise dampening member element 12 or element 12A yields elastically to permit the exhaust air to escape into the atmosphere.

This elastic yielding provides a surprisingly efficient noise damping. The exiting air passes between the expanding ring member 12 or element 12A and the walls of the circumferential grooves 11 as shown by the arrows. In the case of a tightly wound ring spring element 12A, the expanding windings provide spacings between neighboring windings through which the air may also escape. In both instances an efficient noise damping is achieved.

In addition to an effective noise damping, the present damper ring, which is preferably an O-ring, has the advantage of closing the air exhaust ports 10 when the tool is not in operation, thereby preventing contaminations from entering and clogging these air exhaust ports 10.

Although the invention has been described with reference to specific example embodiments, it will be appreciated that it is intended to cover all modifications and equivalents within the scope of the appended claims.

What I claim is:

1. A pneumatically operable tool comprising a tool housing having an outside housing surface, at least one air exhaust channel inside said tool housing, at least one air exhaust port communicating said at least one air exhaust channel through said outside housing surface with the atmosphere outside said tool housing, an exhaust noise damper positioned on the outside surface of said tool housing to close said at least one air exhaust port to the atmosphere when said tool is not in operation, said exhaust noise damper comprising an elastical ring having an elasticity for repeatedly elastically yielding outwardly away from said outside housing surface in response to each exhaust stroke when said tool is operated to thereby permit escape of exhaust air through said air exhaust port and to damp exhaust noise, said tool housing further comprising a circumferential groove having a funnel shaped cross-section in said outside housing surface of said tool housing, said circumferential groove being open to the atmosphere, said at least one air exhaust port opening into said circumferential groove, said elastical ring being seated in said circumferential groove for closing said air exhaust port when said tool is not in operation.

2. The pneumatically operable tool of claim 1, wherein said funnel-shaped cross-section opens and widens radially outwardly to the atmosphere.

3. The pneumatically operable tool of claim 1, wherein said elastical ring is made of one of rubber and synthetic material.

4. The pneumatically operable tool of claim 3, wherein said elastical ring is an O-ring.

5. The pneumatically operable tool of claim 1, wherein said elastical ring is a tightly wound metal wire ring spring of sufficient elasticity for said elastical yielding.

6. The pneumatically operable tool of claim 1, wherein said elastical ring is hollow.

7. The pneumatically operable tool of claim 1, wherein said tool housing comprises a cylinder head, and wherein said circumferential groove having said funnel-shaped cross-section open to the atmosphere is positioned in said cylinder head.

* * * * *

UNITED STATES PATENT AND TRADEMARK OFFICE

CERTIFICATE OF CORRECTION

PATENT NO. : 5,432,307

DATED : July 11, 1995

INVENTOR(S) : Mauer

It is certified that error appears in the above-indentified patent and that said Letters Patent is hereby corrected as shown below:

Col. 1, line 52, replace "tools" by --tool--.

Col. 2, line 15, replace "toll" by --tool--;
line 25, replace "valve 5" by --valve 4--;
line 29, replace "parts" by --ports--, after "space" insert --or channel--;
line 30, delete "openings", replace "parts" by --ports--;
line 58, replace "metal only" by --metal. Only--.

Signed and Sealed this

Twenty-sixth Day of September, 1995

*Attest:*

*Attesting Officer*

BRUCE LEHMAN

*Commissioner of Patents and Trademarks*